US009737177B2

(12) United States Patent
Ciavarella et al.

(10) Patent No.: US 9,737,177 B2
(45) Date of Patent: Aug. 22, 2017

(54) TWO-PART FLUID DELIVERY SYSTEMS

(71) Applicant: GOJO Industries, Inc., Akron, OH (US)

(72) Inventors: Nick E. Ciavarella, Seven Hills, OH (US); John J. McNulty, Broadview Heights, OH (US); Chris Fricker, Copley, OH (US)

(73) Assignee: GOJO Industries, Inc., Akron, OH (US)

( * ) Notice: Subject to any disclaimer, the term of this patent is extended or adjusted under 35 U.S.C. 154(b) by 8 days.

(21) Appl. No.: 14/717,429

(22) Filed: May 20, 2015

(65) Prior Publication Data

US 2015/0335208 A1 Nov. 26, 2015

Related U.S. Application Data

(60) Provisional application No. 62/000,898, filed on May 20, 2014.

(51) Int. Cl.
*B67D 7/76* (2010.01)
*A47K 5/14* (2006.01)
(Continued)

(52) U.S. Cl.
CPC ..... *A47K 5/14* (2013.01); *A47K 5/1211* (2013.01); *B05B 7/0043* (2013.01);
(Continued)

(58) Field of Classification Search
CPC ..... A47K 5/14; A47K 5/1217; A47K 5/1211; B05B 7/0018; B05B 7/0037;
(Continued)

(56) References Cited

U.S. PATENT DOCUMENTS 2,904,222 A 9/1959 Philippe
3,851,801 A 12/1974 Roth
(Continued)

FOREIGN PATENT DOCUMENTS

CH 676227 A5 12/1990
EP 1147818 A1 10/2001
(Continued)

OTHER PUBLICATIONS

European Patent Office Search Report issued Jan. 7, 2011 in EP Application No. 09 150 880.2; 4 pages.
(Continued)

*Primary Examiner* — Lien Ngo
(74) *Attorney, Agent, or Firm* — Calfee, Halter & Griswold LLP

(57) ABSTRACT

Exemplary dispensers, pumps and refill units for dispensing a liquid soap and concentrate mixtures are disclosed herein. An exemplary foam dispenser system includes a foamable liquid container, a concentrate container, an air source for providing pressurized air and a mixing chamber. One or more liquid conduits place the contents of the foamable liquid container in fluid communication with the mixing chamber. One or more air passages place the air source in fluid communication with the mixing chamber. An outlet conduit out of the mixing chamber is also provided. One or more concentrate conduits place the contents of the concentrate container in fluid communication with one of the liquid conduits, the air conduits, the mixing chamber and the outlet conduit. Mix media located within the outlet conduit.

19 Claims, 4 Drawing Sheets

(51) Int. Cl.

| | |
|---|---|
| ***A47K 5/12*** | (2006.01) |
| ***B05B 11/00*** | (2006.01) |
| ***B05B 7/00*** | (2006.01) |
| *B05B 7/04* | (2006.01) |
| *B05B 12/12* | (2006.01) |

(52) U.S. Cl.
CPC ..... *B05B 11/3059* (2013.01); *B05B 11/3084* (2013.01); *B05B 7/0408* (2013.01); *B05B 11/0078* (2013.01); *B05B 11/3087* (2013.01); *B05B 12/122* (2013.01)

(58) Field of Classification Search
CPC ... B05B 1/3084; B05B 1/3059; B05B 1/0078; B05B 1/30871; B05B 7/0043; B05B 7/0408; B05B 12/122
USPC ..... 222/190.137, 145.5, 145.6, 64–66
See application file for complete search history.

(56) References Cited

U.S. PATENT DOCUMENTS

| | | | | |
|---|---|---|---|---|
| 3,995,167 | A * | 11/1976 | Kulig | G01F 23/292 222/65 |
| 4,168,020 | A | 9/1979 | Benson | |
| 4,330,071 | A | 5/1982 | Ohlson | |
| 4,360,130 | A | 11/1982 | Nishimura et al. | |
| 4,793,522 | A | 12/1988 | Corsette | |
| 4,880,161 | A | 11/1989 | Wright | |
| 4,986,453 | A | 1/1991 | Lina et al. | |
| 5,100,030 | A | 3/1992 | Roggenburg et al. | |
| 5,174,476 | A | 12/1992 | Steiner et al. | |
| 5,209,377 | A | 5/1993 | Steiner et al. | |
| 5,271,530 | A | 12/1993 | Uehira et al. | |
| 5,439,140 | A | 8/1995 | Meyer | |
| 5,439,144 | A | 8/1995 | Holzner | |
| 5,445,288 | A | 8/1995 | Banks | |
| 5,462,208 | A | 10/1995 | Stahley et al. | |
| 5,556,005 | A | 9/1996 | Banks | |
| 5,605,256 | A | 2/1997 | Fan | |
| 5,799,841 | A | 9/1998 | Wirt | |
| 5,813,576 | A | 9/1998 | Iizuka et al. | |
| 5,823,397 | A | 10/1998 | Gil | |
| 5,826,755 | A | 10/1998 | Burd | |
| 5,862,954 | A | 1/1999 | Ehrensperger | |
| 5,899,363 | A | 5/1999 | Bliss, III et al. | |
| 5,906,299 | A | 5/1999 | Hagleitner | |
| 6,016,936 | A | 1/2000 | Fan | |
| 6,065,647 | A | 5/2000 | Bliss, III et al. | |
| 6,082,586 | A | 7/2000 | Banks | |
| 6,283,330 | B1 | 9/2001 | Gillespie et al. | |
| 6,409,050 | B1 | 6/2002 | Ophardt et al. | |
| 6,446,840 | B2 | 9/2002 | Ophardt et al. | |
| 6,626,332 | B2 | 9/2003 | Ehrensperger et al. | |
| 6,971,549 | B2 | 12/2005 | Leifheit et al. | |
| 7,059,282 | B2 | 6/2006 | Vorih et al. | |
| 7,377,758 | B2 | 5/2008 | Sallows et al. | |
| 7,537,140 | B2 | 5/2009 | Lin | |
| 7,815,076 | B2 | 10/2010 | Ophardt | |
| 7,819,289 | B2 | 10/2010 | Willis | |
| 8,047,404 | B2 | 11/2011 | Quinlan et al. | |
| 8,579,159 | B2 | 11/2013 | Ciavrella | |
| 8,814,005 | B2 | 8/2014 | Banks et al. | |
| 2003/0000967 | A1 | 1/2003 | Ehrensperger | |
| 2004/0031816 | A1 | 2/2004 | Schuman | |
| 2004/0206772 | A1 | 10/2004 | Leifheit | |
| 2005/0205600 | A1 * | 9/2005 | Ophardt | B05B 7/0037 222/1 |
| 2005/0258192 | A1 | 11/2005 | Matthews et al. | |
| 2005/0284887 | A1 | 12/2005 | Lewis et al. | |
| 2006/0273114 | A1 | 12/2006 | Ophardt | |
| 2007/0272709 | A9 | 11/2007 | Ciavarella et al. | |
| 2007/0278247 | A1 * | 12/2007 | Banks | B05B 7/2497 222/132 |
| 2008/0237265 | A1 | 10/2008 | Brouwer | |
| 2008/0237266 | A1 | 10/2008 | Ciavarella et al. | |
| 2008/0272148 | A1 | 11/2008 | Malik et al. | |
| 2009/0008408 | A1 | 1/2009 | Ophardt et al. | |
| 2009/0277928 | A1 * | 11/2009 | Bruckner | B05B 11/0078 222/129 |
| 2010/0096412 | A1 | 4/2010 | Law | |
| 2010/0147894 | A1 | 6/2010 | Reimann et al. | |
| 2011/0079614 | A1 | 4/2011 | Ganzeboom et al. | |
| 2012/0037657 | A1 * | 2/2012 | Mazzotta | G01F 23/0007 222/1 |
| 2012/0217267 | A1 | 8/2012 | Bunoz et al. | |
| 2013/0119083 | A1 * | 5/2013 | Ophardt | A47K 5/1204 222/64 |
| 2013/0175296 | A1 | 7/2013 | Gray | |
| 2013/0315031 | A1 | 11/2013 | Bunoz et al. | |
| 2014/0110434 | A1 | 4/2014 | Ciavarella | |
| 2014/0124531 | A1 | 5/2014 | Muderlak et al. | |
| 2014/0217117 | A1 | 8/2014 | Mirbach | |
| 2015/0216369 | A1 * | 8/2015 | Hamilton | A47K 5/1217 222/1 |
| 2015/0320266 | A1 * | 11/2015 | Creaghan | A47K 5/14 222/190 |

FOREIGN PATENT DOCUMENTS

| | | | |
|---|---|---|---|
| EP | 2080464 | A2 | 7/2009 |
| EP | 2080560 | A1 | 7/2009 |
| GB | 1269545 | | 4/1972 |
| GB | 2301812 | | 12/1996 |
| GB | 2472235 | | 2/2011 |
| JP | 2012006601 | A | 1/2012 |
| WO | 2005105320 | A1 | 11/2005 |
| WO | 2008049854 | A1 | 5/2008 |
| WO | 2011012836 | A1 | 2/2011 |
| WO | 2011157975 | A1 | 12/2011 |

OTHER PUBLICATIONS

International Search Report and Written Opinion from International Application No. PCT/US2013/056106, date of mailing Nov. 7, 2013; 10 pages.
International Search Report and Written Opinion from International Application No. PCT/US2013/067158, date of mailing Apr. 11, 2014; 16 pages.
International Search Report and Written Opinion from International Application No. PCT/US2013/067366, date of mailing Apr. 11, 2014; 18 pages.
International Search Report and Written Opinion from International Application No. PCT/US2013/056964, date of mailing Nov. 7, 2013; 12 pages.
International Search Report and Written Opinion from International Application No. PCT/US2013/056549, date of mailing Jan. 15, 2014; 16 pages.
International Search Report and Written Opinion from International Application No. PCT/US2014/035072, date of mailing Jul. 23, 2014.
International Search Report and Written Opinion from International Application No. PCT/US2014/012440, date of mailing Jun. 23, 2014.
International Search Report and Written Opinion from International Application No. PCT/US2014/042252, date of mailing Sep. 24, 2014.
International Search Report and Written Opinion from International Application No. PCT/US2014/067047, date of mailing Feb. 12, 2015.

* cited by examiner

TWO-PART FLUID DELIVERY SYSTEMS

RELATED APPLICATIONS

This application claims priority to and the benefits of U.S. Provisional Patent Application Ser. No. 62/000,898 filed on May 20, 2014 and entitled "TWO-PART FLUID DELIVERY SYSTEMS," which is incorporated herein by reference in its entirety.

TECHNICAL FIELD

The present invention relates generally to pumps, refill units for dispensers and dispenser systems, and more particularly to inverted two-part fluid delivery system.

BACKGROUND OF THE INVENTION

Fluid dispenser systems, such as fluid soap dispensers, provide a user with a predetermined amount of fluid upon actuation of the dispenser. In addition, it is sometimes desirable to dispense the fluid in the form of foam by, for example, injecting air into a liquid to create a foamy mixture of liquid and air bubbles. Existing soap dispensers have become very popular; however, the efficacy of the soap solutions in killing bacteria is not always as high as desired.

SUMMARY

Exemplary dispensers, pumps and refill units for dispensing a liquid soap and concentrate mixtures are disclosed herein. An exemplary foam dispenser system includes a foamable liquid container, a concentrate container, an air source for providing pressurized air and a mixing chamber. One or more liquid conduits place the contents of the foamable liquid container in fluid communication with the mixing chamber. One or more air passages place the air source in fluid communication with the mixing chamber. An outlet conduit out of the mixing chamber is also provided. One or more concentrate conduits place the contents of the concentrate container in fluid communication with one of the liquid conduits, the air conduits, the mixing chamber and the outlet conduit. The conduit includes mix media located therein and an outlet.

Another exemplary foam dispenser includes a concentrate receptacle, a concentrate pump, a foamable liquid receptacle, a foamable liquid pump and an air pump. The system further includes a mixing chamber, a concentrate inlet, a foam generator and an outlet. The concentrate pump pumps concentrate from the concentrate receptacle to the concentrate inlet. The foamable liquid pump pumps foamable liquid from the foamable liquid receptacle to the mixing chamber and the air pump pumps air into the mixing chamber. The concentrate, foamable liquid and air form a mixture that is forced through at least a portion of a foam generator and the mixture is dispensed through the outlet as a foam.

Another exemplary foam dispenser includes a concentrate receptacle, a concentrate pump, and a receptacle for receiving a refill unit. The refill unit includes a foamable liquid container, a foamable liquid pump and a mixing chamber having an outlet. A conduit configured to releasably engage with the outlet of the refill unit when the refill unit is installed in the foam dispenser is also included. A concentrate inlet is in fluid communication with the conduit. A foam generator is located at least partially downstream of the concentrate inlet and an outlet is also included.

Another exemplary dispenser includes a concentrate receptacle, a concentrate pump and a receptacle for receiving a refill unit that includes a liquid container and a liquid pump. A conduit configured to releasably engage with the outlet of the refill unit when the refill unit is installed in the dispenser is also included. A concentrate inlet is in fluid communication with the conduit. A turbulence generator is located at least partially downstream of the concentrate inlet; and the dispenser also includes an outlet.

BRIEF DESCRIPTION OF THE DRAWINGS

These and other features and advantages of the present invention will become better understood with regard to the following description and accompanying drawings in which.

DETAILED DESCRIPTION

The term concentrate, as used herein, means a concentrated liquid or concentrated powder. In many embodiments, the concentrate has active ingredients, such as, for example, an oxidizer that is in liquid form or a powder that readily dissolves in the fluid with which it is being mixed. Active ingredients may include highly reactive species, biological cells, probiotics, fluids or powders that are unstable long term with the foamable fluid, colorants that are unstable when exposed to light, fragrance, and the like. In addition, the concentrate actives may be, for example, ethanol, isopropanal, PCMX, quats, and the like.

Figure 1:
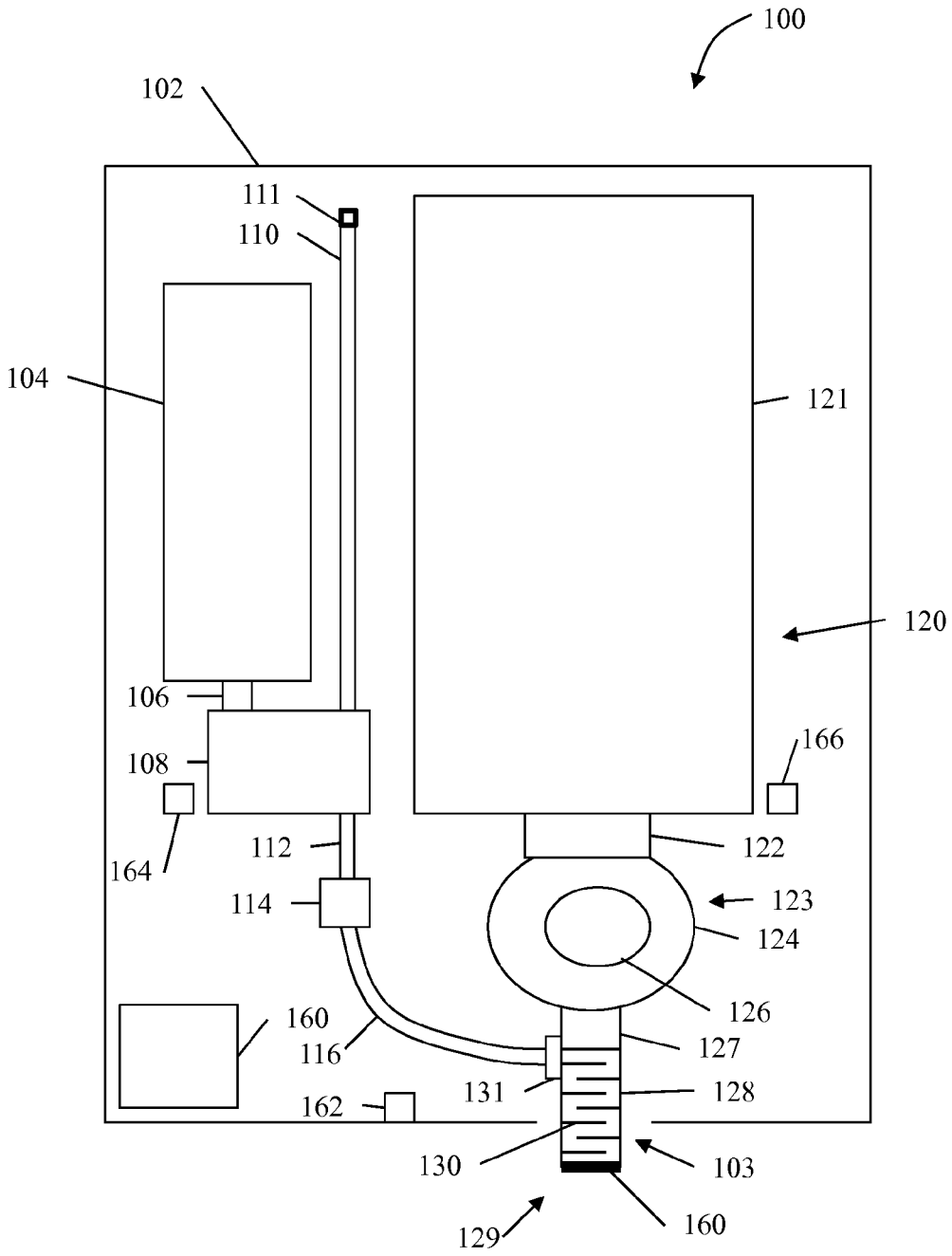
FIG. 1 illustrates an exemplary two-part fluid delivery system with a disposable foam refill unit and a liquid concentrate.

FIG. 1 illustrates an exemplary embodiment of an exemplary two-part fluid delivery system 100 with a disposable foam soap refill unit 120 and a replaceable liquid concentrate container 104. In most cases, the concentrates may irritate skin if placed in direct contact with skin. Accordingly, the concentrate must be thoroughly mixed with the liquid prior to dispensing the output on to a person's hand. Refill unit 120 includes a container 121 for holding a foamable liquid. In some embodiments, the foamable liquid is a soap, a lotion or a sanitizer. Container 121 includes a neck 122 having a foam pump 123 that includes an air pump 124, a liquid pump 126 and an outlet conduit 127. Foam pump 123 may be any foam pump, such as for example, the foam pumps shown and described in co-pending U.S. patent application Ser. No. 13/792,011 titled Horizontal Pumps, Refill Units and Foam Dispensers, which was filed on Mar. 9, 2013; co-pending U.S. patent application Ser. No. 13/792,115 titled Horizontal Pumps, Refill Units and Foam Dispensers, which was filed on Mar. 10, 2013; and co-pending U.S. Provisional Pat. Appl. Ser. No. 61/835,273 titled Foam Cartridges, Pumps, Refill Units and Foam Dispensers Utilizing the Same, which was filed on Jun. 14, 2013. Each of which is incorporated herein by reference in its entirety.

The foam pumps identified above may need to be modified slightly to accommodate outlet conduit 128. In addition, the screens, foaming cartridges and/or mix media described in those applications may be replaced by one of the foam generators identified and disclosed in co-pending U.S. Pat. Appl. Ser. No. 61/916,706 ("the '706 application") titled Foam-At-A-Distance Systems, Foam Generators and Refill Units, which was filed on Dec. 16, 2013 and is incorporated by reference herein in its entirety. Although these foam generators, which contain a plurality of baffles 130, were designed for mixing foam at a distance from the air and liquid pumps, it has been discovered that they work very well in thoroughly mixing the liquid and the active concentrate.

Air pump 124 is in fluid communication with mixing chamber 127. Liquid pump 126 is in also in fluid communication with mixing chamber 127. Conduit 128 includes a concentrate inlet 131. Concentrate inlet 131 may be located to direct the concentrate into the fluid stream slightly below the mixing chamber 127 (as shown), into the mixing chamber 127, or into the liquid flowing out of liquid pump 126 above the mixing chamber 127.

The two stage mixing foam soap delivery system 100 includes a concentrate container 104. In some embodiments, the concentrate container 104 is filled with a concentrated oxidizer. Concentrate container 104 includes a vented connector 106. The vented connector 106 connects the concentrate container 104 to a concentrate reservoir 108 and vents concentrate container 104 so that concentrate will flow out of concentrate container 104 into concentrate reservoir 108. Concentrate reservoir 108 also includes a vent 110 that vents concentrate reservoir 108 and allows fluid to be pumped out of concentrate reservoir 106 through conduit 112 by concentrate pump 114. In some embodiments, vent 110 includes a filter 111 to filter out odors. Filter 111 may be, for example, a carbon filter. In some embodiments, concentrate pump 114 is permanently connected to dispenser housing 102. Concentrate pump 114 pumps concentrate through conduit 116 which is connected to concentrate inlet 131. Concentrate pump 114 is preferably capable of providing consistent sized small doses of concentrate into the fluid mixture.

Located in the conduit 128 below mixing chamber 127 is a plurality of baffles 130. Baffles 130 cause severe turbulence in the mixture of air, foamable liquid, and concentrate to thoroughly mix the ingredients and to cause the mixture to turn into a rich foam that is safe for use.

The exemplary two-part fluid delivery system 100 is a touch free system and includes a detector 162 for detecting the presence of an object below the outlet 129 of the delivery system 100. Detector 162 may be any detector, such as, for example, an infrared detector, a motion detector, a capacitance detector or the like. Detector 162 is in circuit communication with power and control circuitry 160. In addition, two-part fluid delivery system 100 includes a liquid level sensor 166 and a concentrate level sensor 164, which are both in circuit communication with power and control circuitry 160. In some embodiments, the two-part fluid delivery system 100 includes redundant liquid level sensors 166 to ensure that the two-part fluid delivery system 100 will not deliver concentrate if the liquid container 121 is out of liquid.

The two-part fluid delivery system 100 includes a power source, not shown, such as for example batteries to provide power to the power and control circuitry, drive circuitry (not shown) and other components (not shown) that are required to operate pumps 124 and 126. Level sensor 164 and 166 may be any type of level sensors, such as a float sensor, a weight sensor, a color sensor that detects the presence of a colored fluid in the container or reservoir.

Power and control circuitry 160 includes interlock logic for preventing operation of the dispenser in the event that the liquid in container 121 runs out. The interlock logic prevents concentrate from being dispensed onto a user's hands and may be referred to herein throughout as a safety interlock. Similarly, in some embodiments, interlock logic prevents the dispensing of the foamable liquid in the form of a foam if the concentrate runs out. This may also may be referred to herein as a safety interlock, because, although dispensing the foam would not harm a user, the user would be obtaining a product that did not include the desired cleaning characteristic if the dispenser dispensed the liquid without concentrate.

In addition, in some embodiments a pressure sensor (not shown) is included that is activated by pressure caused by pumping liquid from container 121. The pressure sensor may be a physical pressure sensor, or in some embodiments a logic pressure sensor. A logic pressure sensor may, for example, monitor the current required to operate foam pump 123 and if the current rises above a selected threshold, the logic pressure sensor determines refill unit 120 is empty and the interlock logic prevents operation of delivery system 100.

Normally, during operation, when an object is detected by detector 162, liquid pump 126, air pump 124, and concentrate pump 114 are activated. The liquid, air and concentrate are mixed together and forced through baffles 130 and are dispensed out of outlet 129 as a rich foam.

When refill unit 120 is empty, the refill unit 120, including the liquid pump 126 and air pump 124 are removed and replaced. In some embodiments, the refill unit 120 may releasably connect to conduit 128. In such embodiments, conduit 128 remains with the dispenser housing 102 when refill unit 120 is removed. In some embodiments conduit 128 is part of the replaceable refill unit 120 and is removed with the refill unit. In such cases, conduit 116 releasably connects to the concentrate inlet 131 of conduit 128. Similarly, when concentrate container 104 is empty, concentrate container 104 may be replaced with a full concentrate container 104. In some embodiments, concentrate reservoir 208 is larger and refillable without connecting to a concentrate container 104. In such an embodiment, concentrate is poured into the bulk refill reservoir 208.

In some embodiments, two-part fluid delivery system 100 includes a "neat dispense" mechanism 160 located at the end of conduit 128. Neat dispense mechanism 160 may be, for example, a silicon outlet valve, such as, for example an LMS valve. In some embodiments, air pump 124 is designed to provide "suck back" of residual foam in conduit 128.

In some embodiments, an antifouling plastic additive may be added to one or more of the parts that contact the concentrate and remain with the dispenser housing 102 when the refill unit is removed.

The power and control circuitry 160, sensors 164, 166, 162, neat dispense mechanisms 160, antifouling additives, logic etc. described above, may be included in any of the embodiments described herein.

Figure 2:
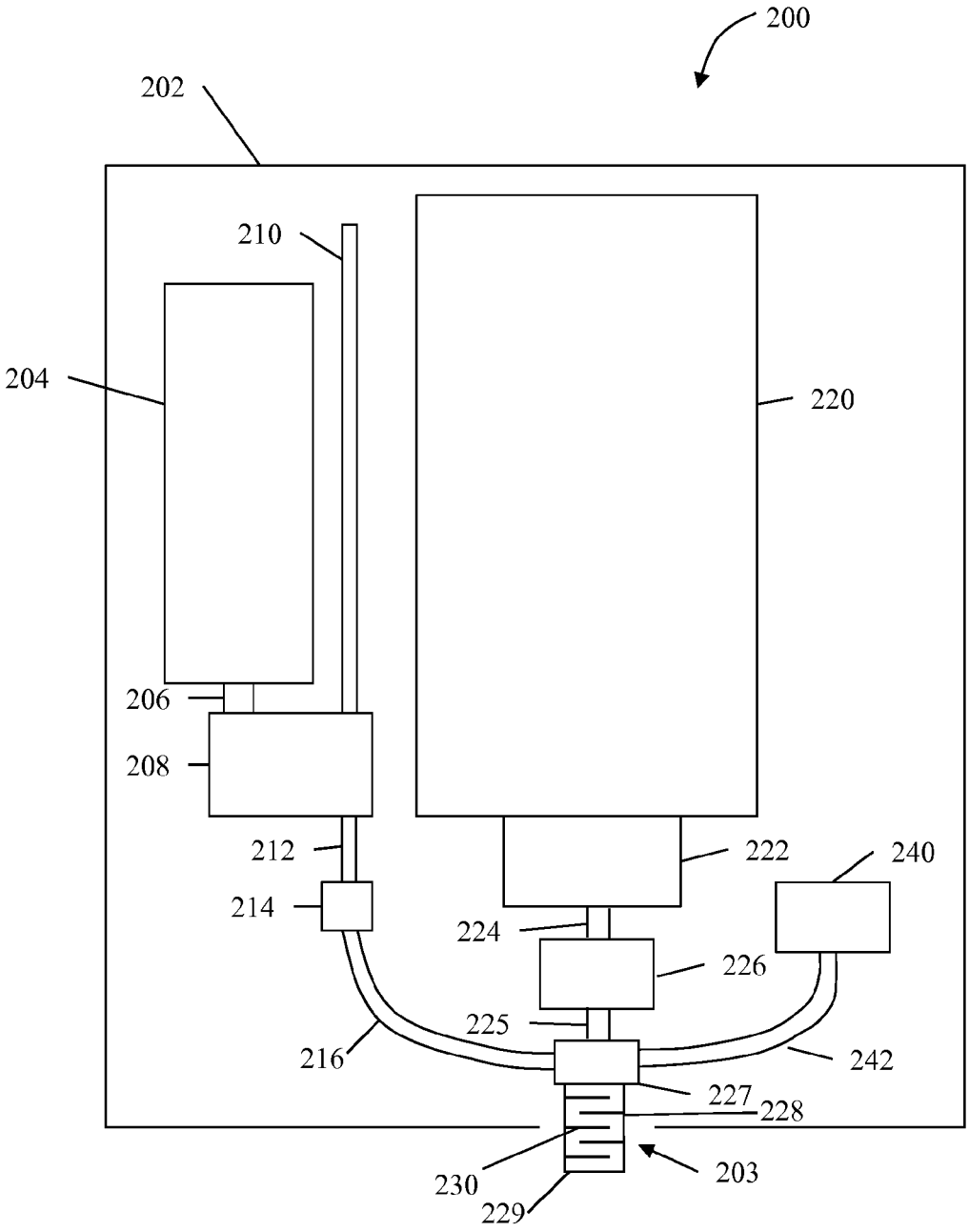
FIG. 2 illustrates another exemplary two-part fluid delivery system with a liquid concentrate.

FIG. 2 is a schematic diagram of two-part fluid delivery system 200 that utilizes permanent air pump 240, a permanent liquid pump 226 and a permanent concentrate pump 214, each which are affixed to housing 202.

Liquid container 220 connects to liquid reservoir 222 with a vented connector (not shown). In some embodiments, system 200 is a bulk refill system and reservoir 222 is larger and holds the entire supply of liquid. Liquid reservoir 222 is in fluid communication with liquid pump 226 via conduit 224. Liquid pump 226 is in fluid communication to mixing chamber 227 through conduit 225. Air pump 240 is in fluid communication with mixing chamber 227 through conduit 242. In some embodiments, the liquid in container 220 is self-preserving, such as for example, a liquid soap containing about 15% alcohol.

The two-part fluid delivery system 200 includes a concentrate container 204. In some embodiments, the concentrate container 204 is filled with a concentrated oxidizer. Concentrate container 204 includes a vented connector 206. The vented connector 206 connects the concentrate container 204 to a concentrate reservoir 208 and vents concentrate container 204 so that concentrate will flow out of concentrate container 204 into concentrate reservoir 208. Concentrate reservoir 208 also includes a vent 210 that vents concentrate reservoir 208 and allows fluid to be pumped out of concentrate reservoir 206 through conduit 212 by concentrate pump 214. Vent 210 may include a filter (not shown) similar to filter 111. Concentrate pump 214 is permanently connected to dispenser housing 202. Concentrate pump 214 pumps concentrate through conduit 216 which is connected to concentrate inlet 231. Concentrate pump 214 is preferably capable of providing consistent sized small doses of concentrate into the fluid mixture.

Located in the conduit 228 below mixing chamber 227 is a plurality of baffles 230. Baffles 230 cause severe turbulence in the mixture of air, foamable liquid, and concentrate to thoroughly mix the ingredients and to cause the mixture to turn into a rich foam.

Two-part fluid delivery system 200 is a touch free system and includes the components discussed above with respect to FIG. 1, which are not shown in FIG. 2 for purposes of clarity. As described above, an interlocking mechanism, such as interlocking logic is included to prevent concentrate from being dispensed onto a user's hands when the liquid in container 220 runs out. Similarly, in some embodiments, the logic prevents the dispensing of the foamable liquid in the form of a foam if the concentrate runs out.

During operation, when an object is detected, liquid pump 226, air pump 224, and concentrate pump 214 are activated. The liquid, air and concentrate are mixed together and forced through baffles 130 and are dispensed out of outlet 129 as a rich foam.

When refill unit 220 it is removed and replaced. In this embodiment, preferably the liquid in refill unit 220 includes a percentage of alcohol, such as for example, of about 15% alcohol to inhibit growth of bacteria and/or bio films in reservoir 222, pump 226, conduits 224, 225 and 228. When concentrate container 204 is empty, concentrate container 204 may be replaced with a full concentrate container 204. In some embodiments, concentrate reservoir 208 is larger and refillable without connecting to a concentrate container 204. In such an embodiment, concentrate is poured into reservoir 208.

Figure 3:
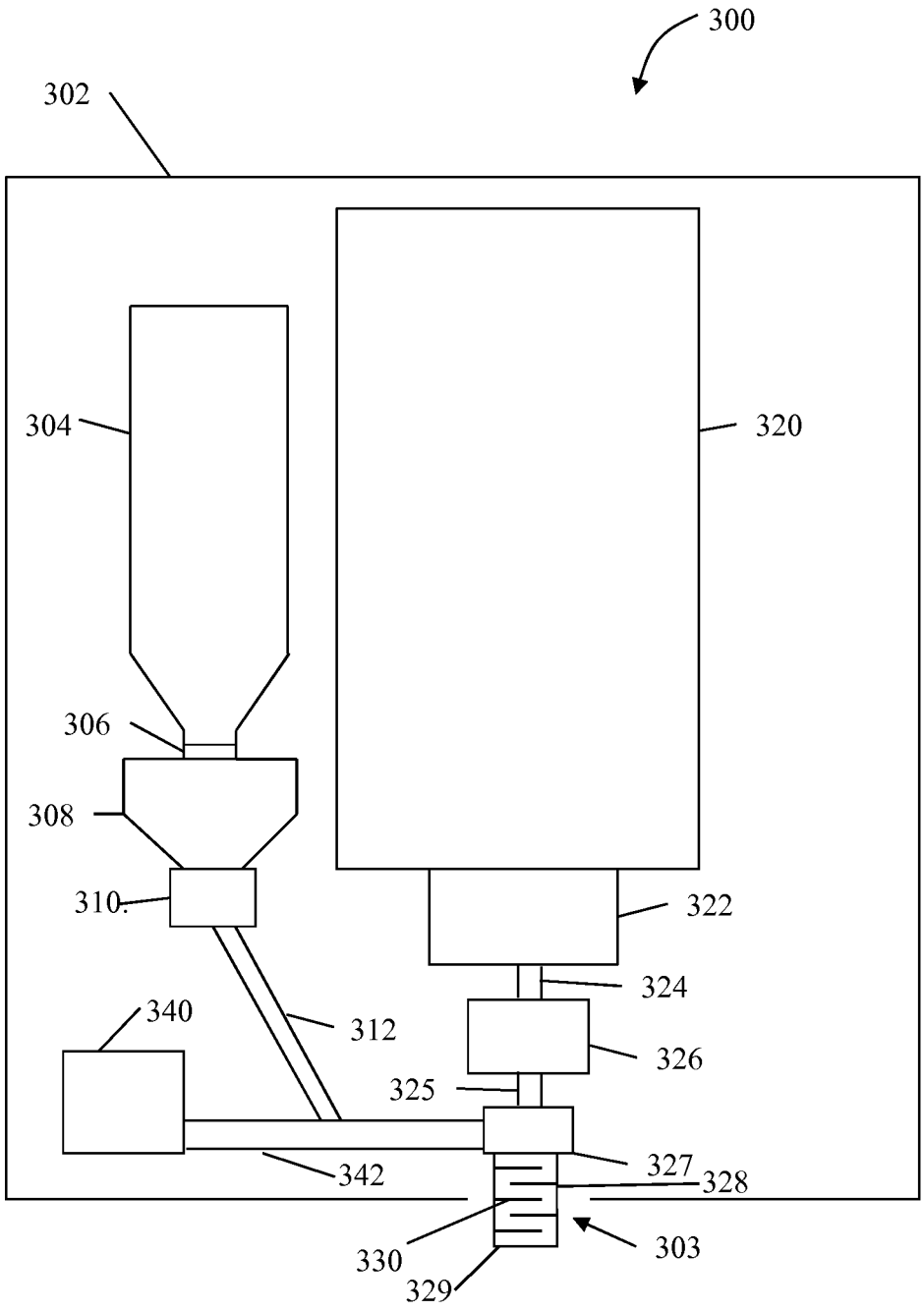
FIG. 3 illustrates an exemplary two-part fluid delivery system with a powder concentrate.

FIG. 3 is a schematic diagram of a two-part fluid delivery system 300 that includes a powder concentrate, such as for example an oxidizer in a powder form.

Liquid container 320 connects to liquid reservoir 322 with a vented connector (not shown). In some embodiments, system 300 is a bulk refill system and reservoir 322 is larger and holds the entire supply of liquid. In some embodiments, there is no reservoir 322 and liquid pump 326 is secured to container 320. In some embodiments, the liquid container 320 and pump 326 are connected to one another and form a refill unit that is replaceable. Liquid reservoir 322 is in fluid communication with liquid pump 326 via conduit 324. Liquid pump 326 is in fluid communication with mixing chamber 327 through conduit 325.

Air pump 340 is in fluid communication with mixing chamber 327 through conduit 342. The two stage mixing foam soap delivery system 300 includes a powder concentrate container 304. In some embodiments, the powder concentrate container 304 is filled with a concentrated powder oxidizer. Concentrate container 304 includes a vented connector 306. The vented connector 306 connects the concentrate container 304 to a concentrate reservoir 308 and vents concentrate container 304 so that concentrate will flow out of concentrate container 304 into concentrate reservoir 308. A valve mechanism 310 is connected to concentrate reservoir 308. Valve mechanism 310 provides a metered dose of concentrate into conduit 312, which is in fluid communication with air conduit 342. The powder concentrate is selected to readily dissolve in the liquid that is contained in liquid container 320.

Conduit 328 is located downstream of mixing chamber 327. Located in the conduit 328 is a plurality of baffles 330. Baffles 330 cause severe turbulence in the mixture of air, foamable liquid, and powder concentrate to thoroughly mix the ingredients and to cause the mixture to turn into a rich foam. In some embodiments, the number of baffles 330 may be increased to ensure through mixing of concentrate in foam output.

Two-part fluid delivery system 300 is a touch free system and includes the components discussed above with respect to FIG. 1, which are not shown in FIG. 3 for purposes of clarity. As described above, an interlocking mechanism, such as interlocking logic is include to prevent powder concentrate from being dispensed onto a user's hands when the liquid in container 320 runs out. Similarly, in some embodiments, the interlocking logic prevents the dispensing of the foamable liquid in the form of a foam if the concentrate runs out. In some embodiments, the interlocking mechanism is mechanical interlock (not shown). Although dispensing the foam would not hurt a user, the user would be obtaining a product that did not include the desired features.

During operation, when an object is detected, liquid pump 326, air pump 324, and valve mechanism 310 are activated. A metered dose of powder concentrate flows down conduit 312 and into air flowing through conduit 342. In some embodiments, the metered dose of powder concentrate is released during the priming of the liquid and air pumps and is in conduit 342 prior to detecting of the object. The liquid, the powdered concentrate and air flow into mixing chamber 327 are mixed together and forced through baffles 330 and are dispensed out of outlet 329 as a rich foam.

When liquid container 320 is empty it is removed and replaced. Similarly, when concentrate container 304 is empty, concentrate container 304 may be replaced with a full concentrate container 304. In some embodiments, concentrate reservoir 308 is larger and refillable without connecting to a concentrate container 304. In such an embodiment, concentrate is poured into reservoir 308.

Figure 4:
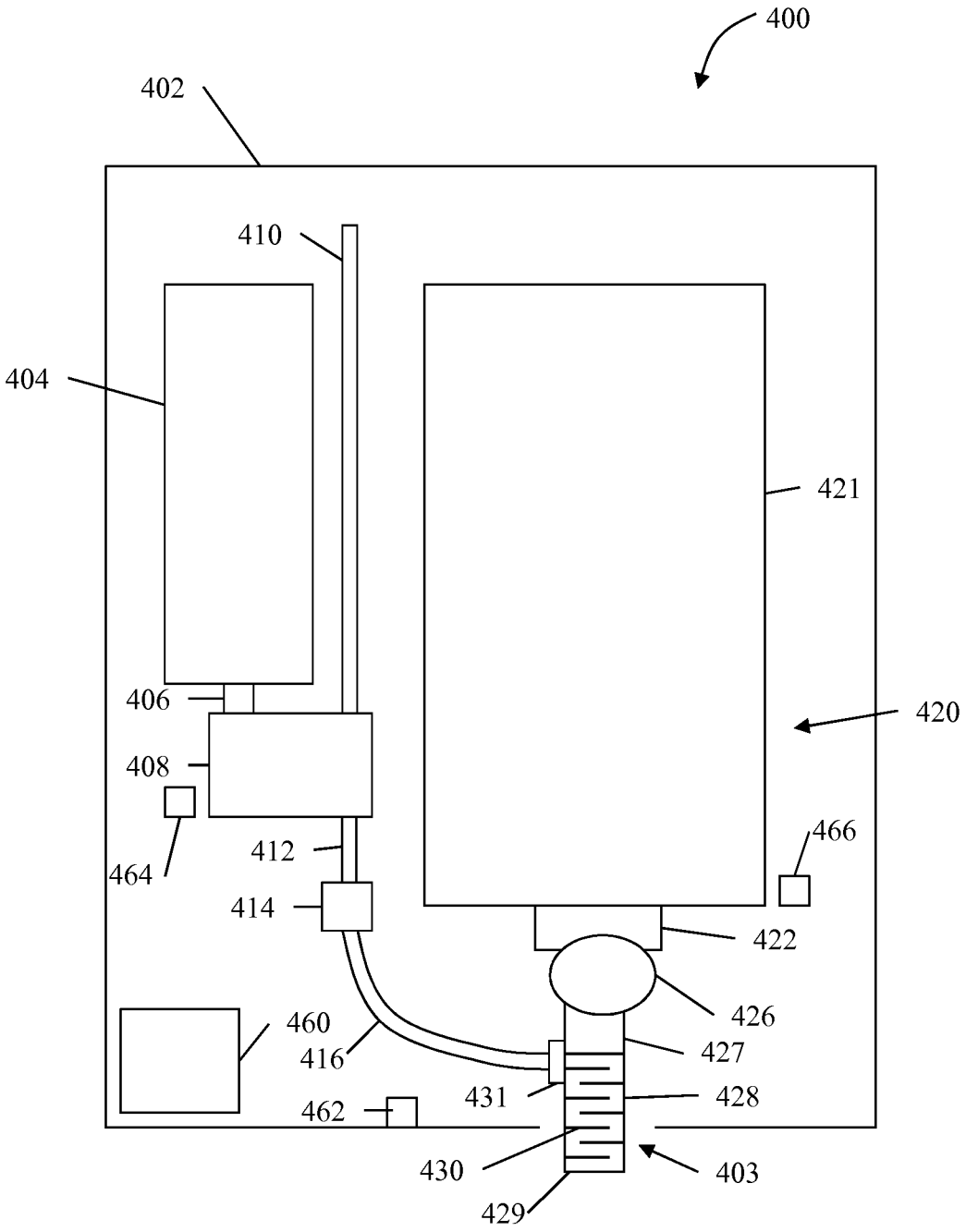
FIG. 4 illustrates an exemplary two-part fluid delivery system with a liquid concentrate.

FIG. 4 illustrates an exemplary embodiment of an exemplary two-part fluid delivery system 400 with a disposable soap refill unit 420 and a replaceable liquid concentrate container 404. Refill unit 420 includes a container 421 for holding a liquid and liquid pump 426. In some embodiments, the liquid is a soap, a lotion or a sanitizer. Preferably, the liquid in container 421 is a thin liquid that will readily mix with the concentrate. Container 421 includes a neck 422 having a liquid pump 426 and an outlet conduit 427. Outlet conduit 427 releasably mates to conduit 428, which is permanently mounted to the dispenser housing 402.

Conduit 428 includes baffles 413 such as, for example, the baffles disclosed in co-pending U.S. Pat. Appl. Ser. No. 61/916,706 ("the '706 application") titled Foam-At-A-Distance Systems, Foam Generators and Refill Units, which was filed on Dec. 16, 2013 and is incorporated by reference herein in its entirety. In some embodiments, the baffles are selected to create maximum turbulence to mix the liquid and concentrate.

Conduit 428 includes a concentrate inlet 431. Concentrate inlet 431 may be located to direct the concentrate into the fluid stream slightly below the mixing chamber (as shown), into the mixing chamber, or into the liquid flowing out of liquid pump 426 above the mixing chamber.

The two-part fluid delivery system 400 includes a concentrate container 404. In some embodiments, the concentrate container 404 is filled with a concentrated oxidizer. Concentrate container 404 includes a vented connector 406. The vented connector 406 connects the concentrate container 404 to a concentrate reservoir 408 and vents concentrate container 404 so that concentrate will flow out of concentrate container 404 into concentrate reservoir 408. Concentrate reservoir 408 also includes a vent 410 that vents concentrate reservoir 408 and allows fluid to be pumped out of concentrate reservoir 406 through conduit 412 by concentrate pump 414. Vent 410 may include a filter (not shown) similar to filter 111. In some embodiments, concentrate pump 414 is permanently connected to dispenser housing 402. Concentrate pump 414 pumps concentrate through conduit 416 which is connected to concentrate inlet 431. Concentrate pump 414 is preferably capable of providing consistent sized small doses of concentrate into the fluid mixture. In some embodiments, the concentrate pump 414 and liquid pump 326 are selected to provide higher pressure output to ensure mixing. In any event, baffles 130 cause severe turbulence in the mixture of liquid and concentrate to thoroughly mix the ingredients and to cause the mixture to thoroughly mix together.

Two-part fluid delivery system 400 is a touch free system, however, like the other embodiments disclosed herein may also be implemented in a manual dispenser.

During operation, when an object is detected by detector 462, liquid pump 426 and concentrate pump 414 are activated. The liquid soap and concentrate are mixed together and forced through baffles 430 and are dispensed out of outlet.

When refill unit 420 is empty, the refill unit, including the liquid pump 426 and air pump 424 are removed and replaced. In such a case, the refill unit 420 releasably connects to conduit 428. In some embodiments, conduit 428 remains with the dispenser when refill unit 420 is removed. In some embodiments conduit 428 is part of the replaceable refill unit 420 and is removed with the refill unit. In such cases, conduit 416 releasably connects to the concentrate inlet 431 of conduit 428. Similarly, when concentrate container 404 is empty, concentrate container 404 may be replaced with a full concentrate container 404. In some embodiments, concentrate reservoir 408 is larger and refillable without connecting to a concentrate container 404. In such an embodiment, concentrate is poured into reservoir 408.

As described above, structural elements disclosed with respect to one embodiment may be included in one or more of the other embodiments.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A foam dispenser system comprising:
a foamable liquid container;
an concentrate container;
an air source for providing pressurized air;
a mixing chamber;
one or more liquid conduits placing the contents of the foamable liquid container in fluid communication with the mixing chamber;
one or more air passages placing the air source in fluid communication with the mixing chamber;
an outlet conduit out of the mixing chamber;
one or more concentrate conduits placing the contents of the concentrate container in fluid communication with one of the liquid conduits, the air conduits, the mixing chamber and the outlet conduit;
mix media located within the outlet conduit; and
a vent for venting the concentrate.

2. The foam dispenser of claim 1 wherein the concentrate container comprises an oxidizer.

3. The foam dispenser of claim 1 wherein the one or more concentrate conduits place the concentrate in fluid communication upstream of at least a portion of the mix media.

4. The foam dispenser of claim 2 wherein the oxidizer is a liquid.

5. The foam dispenser of claim 2 wherein the oxidizer is a powder.

6. The foam dispenser of claim 2 wherein a foam output of the dispenser contains between about 2000 parts per million and about 16,000 parts per million of oxidizer.

7. The foam dispenser of claim 2 wherein a foam output of the dispenser contains between about 6,000 parts per million and about 10,000 parts per million of oxidizer.

8. The foam dispenser of claim 1 wherein the dispenser comprises a housing and a concentrate pump for pumping the concentrate and wherein the concentrate pump is affixed to the housing and the second container for holding the concentrate is removable from the housing for replacement when the concentrate container is empty.

9. The foam dispenser of claim 1 wherein the concentrate conduit is in fluid communications with the liquid conduit upstream of the mixing chamber.

10. The foam dispenser of claim 1 wherein the concentrate conduit is in fluid communications with the air conduit upstream of the mixing chamber.

11. The foam dispenser of claim 1 wherein the mix media comprises a plurality of baffles.

12. The foam dispenser of claim 1 further comprising a level sensor.

13. The foam dispenser of claim 12 wherein the level sensor includes a color sensor for detecting a color to determine whether the level is below a selected level.

14. The foam dispenser of claim 1 further comprising a safety interlock, wherein the safety interlock that prevents dispensing of concentrate if the level of foamable liquid is below a selected level.

15. The foam dispenser of claim 1 further comprising a safety interlock, wherein the safety interlock that prevents dispensing of foamable liquid if the level of concentrate is below a selected level.

16. A foam dispenser comprising:

an concentrate receptacle;

a vent for venting the concentrate;

an concentrate pump;

a foamable liquid receptacle;

a foamable liquid pump;

an air pump;

a mixing chamber;

an concentrate inlet;

a foam generator; and an outlet;

wherein the concentrate pump pumps concentrate from the concentrate receptacle to the concentrate inlet;

wherein the foamable liquid pump pumps foamable liquid from the foamable liquid receptacle to the mixing chamber;

wherein the air pump pumps air into the mixing chamber;

wherein the concentrate, foamable liquid and air form a mixture that is forced through at least a portion of a foam generator and is dispensed through the outlet as a foam.

17. The foam dispenser of claim 16 wherein the foamable liquid receptacle and the foamable liquid pump form a refill unit is removable and replaceable.

18. The foam dispenser of claim 16 wherein the foamable liquid receptacle, the foamable liquid pump, the air pump, and the mixing chamber form a refill unit that is removable and replaceable.

19. A foam dispenser comprising:

an concentrate receptacle;

an concentrate pump;

a receptacle for receiving a refill unit that includes a foamable liquid container, a foamable liquid pump and a mixing chamber having an outlet;

a conduit configured to releasably engage with the outlet of the refill unit when the refill unit is installed in the foam dispenser;

an concentrate inlet in fluid communication with the conduit;

a foam generator located at least partially downstream of the concentrate inlet; and an outlet;

a first sensor for sensing a parameter indicative of the level of concentrate;

a second sensor for sensing a parameter indicative of the level of foamable liquid; and an interlock that prevents dispensing if one of the first sensor and second sensor indicate a low level.

* * * * *